United States Patent [19]

Keller

[11] 4,060,902

[45] Dec. 6, 1977

[54] MULTI-PURPOSE TOOL

[76] Inventor: Gerbert O. Keller, 180 Mattakeesett St., Pembroke, Mass. 02356

[21] Appl. No.: 684,025

[22] Filed: May 7, 1976

[51] Int. Cl.[2] ..... B43L 7/00

[52] U.S. Cl. ..... 33/114; 33/112

[58] Field of Search ..... 33/88, 89, 112, 113, 33/114, 95, 96, 99, 100, 101, 75, 76 R, 102, 103, 77, 82, 85, 92, 93

[56] References Cited

U.S. PATENT DOCUMENTS

| | | | |
|---|---|---|---|
| 494,322 | 3/1893 | Callahan | 33/92 |
| 905,054 | 11/1908 | Chynoweth | 33/88 |
| 1,053,083 | 2/1913 | Blizard | 33/112 |
| 1,298,010 | 3/1919 | Coleman | 33/89 |
| 2,307,892 | 1/1943 | Lowther | 33/88 |
| 2,998,655 | 9/1961 | White | 33/107 R |
| 3,925,899 | 12/1975 | Hesse et al. | 33/75 R |

FOREIGN PATENT DOCUMENTS

| | | | |
|---|---|---|---|
| 7,174 of | 1890 | United Kingdom | 33/99 |
| 717,327 | 10/1954 | United Kingdom | 33/75 R |

*Primary Examiner*—Richard E. Aegerter
*Assistant Examiner*—John W. Shepperd
*Attorney, Agent, or Firm*—Morse, Altman, Oates & Bello

[57] ABSTRACT

A combination straight edge, T-square, level, ruler and guide is provided for use by craftsman such as paper-hangers, carpenters, and the like. The tool includes a relatively wide elongated body formed with parallel straight edges along both long edges, a handle and a plurality of replaceable bubble vials for establishing vertical and horizontal lines. A detachable and adjustable T-bar is provided and is formed with a lip along one edge whereby the T-bar in one position is flush with the bottom edge of the body, and in another position the lip extends downwardly to engage an edge of the work, for example. The T-bar is also provided with replaceable vials as well as a handle so that it may be used independent of the main body of the tool.

5 Claims, 12 Drawing Figures

MULTI-PURPOSE TOOL

BACKGROUND OF THE INVENTION

1. Field of the Invention

This invention relates generally to straight edge tools of the sort used by construction workers, paperhangers, carpenters, hobbyists, or the like, and more particularly is directed towards a new and improved combination level, straight edge, guide, ruler and adjustable T-square of great utility.

2. Description of the Prior Art

Various craftsmen, such as construction workers, paperhangers, carpenters, hobbyists, and the like, often times need to make long, straight cuts or reference lines vertically or horizontally on a fixed wall or on an individual panel. For example, paperhangers normally will start a course of wall cover strips from a vertical and horizontal reference line, which typically may be made using a plumb bob comprised of a weighted string which has been chalked. The string is held against the wall and the weight holds the string taut and vertical. The mark is applied to the wall by snapping the string against the wall to transfer some of the chalk from the string to the wall. While this procedure has been done for many years, it is somewhat slow in that the weighted string tends to swing and cannot be snapped until it is steady. The practice is also awkward and must be done carefully to insure accuracy. Also, in some paperhanging operations, known as double cutting, the wallcovering is overlapped and then cut to bring adjacent edges into butting relation. Other similar tasks include scoring plasterboard panels in order to break off straight sections before installation or checking for bias in print patterns on wallcoverings prior to hanging.

While there are many types of straight edges and levels available to perform some of these functions, heretofore there has been no tool available which is readily adaptable to perform a variety of functions, such as straight edge work, levelling work, scoring and cutting work, or for use in a variety of trades such as wallcovering, carpentry, and the like.

Accordingly, it is an object of the present invention to provide a new and improved multi-purpose tool adaptable for a variety of craft purposes, including straight edge work, levelling work, scoring and cutting work, making linear measurements, and the like.

Another object of this invention is to provide a combination level, straight edge, T-square, and linear measuring rule.

SUMMARY OF THE INVENTION

This invention features a multi-purpose tool comprising a relatively wide, flat, elongated straight edge having a handle in the mid portion thereof and marked along one edge in metric measurement and along the other edge in inches and feet measurement. Replaceable bubble vials are mounted in spaced sockets along the body of the straight edge and a moveable T-bar is detachably connected to either end of the straight edge. The T-bar is formed with a lip along one edge and may be connected at its center portion or at either end, or may be inverted to optionally provide a flush surface at the bottom of a tool or a lip for gripping an edge of the work. An interchangeable handle and optional bubble vials may be provided in the T-bar.

DETAILED DESCRIPTION OF THE PREFERRED EMBODIMENTS

Figures 1, 2, 3, 4, 5, 6, 7, 8, 9, 10, 11, 12:
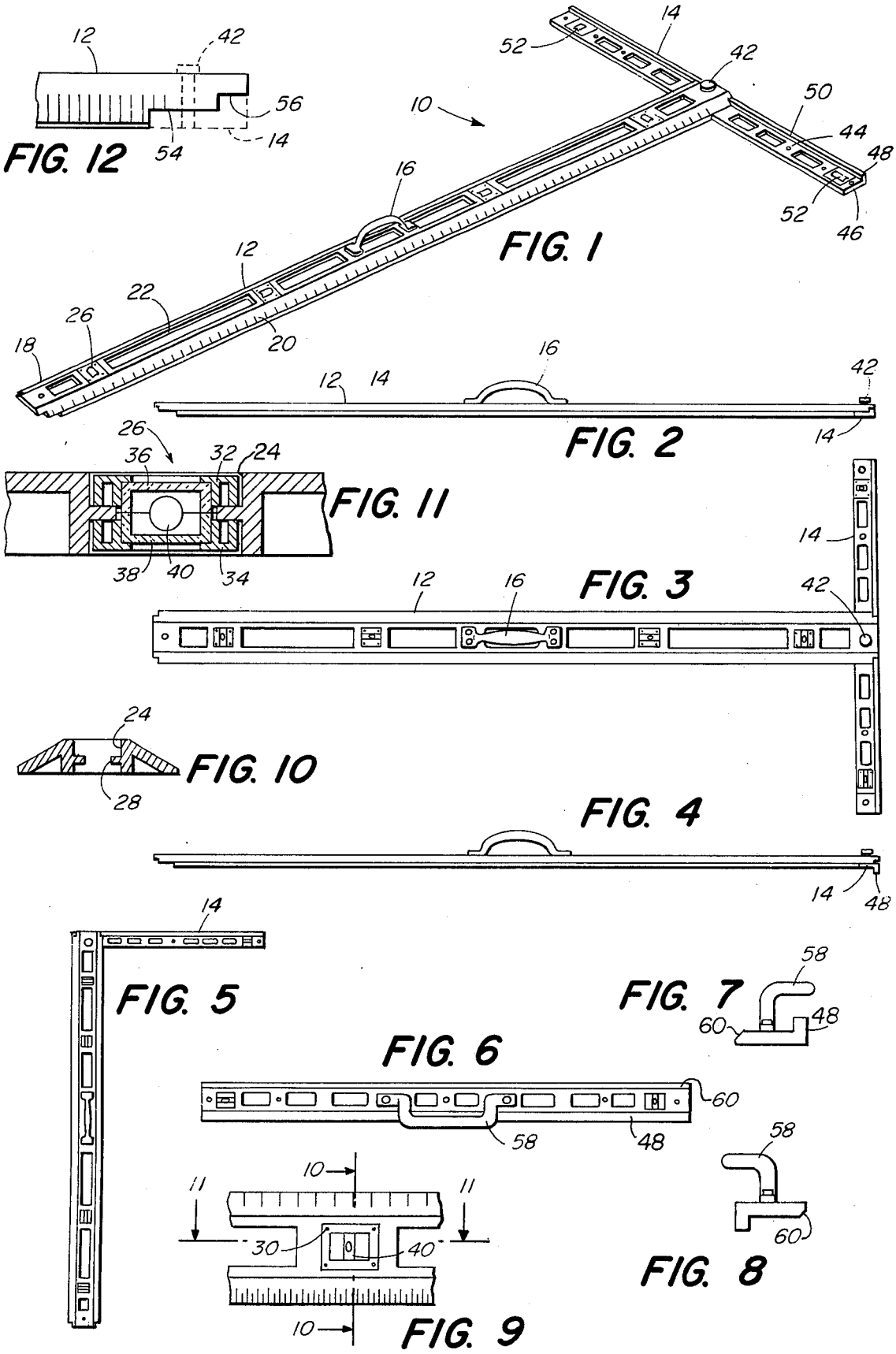
FIG. 1 is a view in perspective of a tool made according to the invention.
FIG. 2 is a view in side elevation thereof.
FIG. 3 is a top plan view thereof.
FIG. 4 is a view similar to FIG. 2 but showing the T-bar in an inverted position.
FIG. 5 is a top plan view of the tool showing the T-bar extended fully to one side of the straight edge.
FIG. 6 is a top plan view of the T-bar separated from the straight edge.
FIG. 7 is an end view of the T-bar showing the detachable handle in one operating position.
FIG. 8 is a view similar to FIG. 7 but showing the handle in alternate position.
FIG. 9 is a detail plan view showing the bubble level mounting arrangement.
FIG. 10 is a cross-sectional view taken along the line 10—10 of FIG. 9.
FIG. 11 is a cross-sectional view taken along the line 11—11 of FIG. 9, and, FIG. 12 is a detail side view showing the configuration of the end of the body portion.

Referring now to the drawings, the reference character 10 generally indicates a multi-purpose tool comprised of a relatively wide, straight, elongated body portion 12 and a detachable T-bar 14 connected to either end thereof. The body portion 12 is provided with a medial handle 16 and is formed with beveled faces along opposite longitudinal marginal edges. The beveled faces 18 and 20 are marked in linear scales, one of which, face 18, is graduated in feet and inches while the face 20 is graduated in metric measurements. The marking indicia may be color coded to facilitate reading the measurements along the straight edges and, for example, the millimeter numbers may be yellow, centimeter numbers red, and the decimeter numbers green.

In the preferred embodiment of the invention, the body portion 12 should be relatively long, on the order of four feet or more, although a shorter length of perhaps two feet may be used for some work. The maximum practical length for the body portion would be in the neighborhood of eight feet or so, but for most general work a four foot length is preferred. The body should be relatively wide and typically may be on the order of 3 to 6 inches in width so as to provide a stiff, wide, flat rule, providing a very stable tool, particularly when using the tool as a straight edge over a long expanse for level work as will be described more fully below.

The body portion 12 may be fabricated from a variety of materials, and, in practice, extruded aluminum has been found to be satisfactory. Other suitable materials including high quality woods, or plastics with metal inserts along the straight edge may also be used to advantage. In practice, the body portion is formed with openings 22 which reduce the weight of the tool and enhance its structural stability.

Detachably mounted in sockets 24 formed along the length of the body section are replaceable bubble level units 26. In the illustrated embodiment four such bubble levels are provided with the outermost levels oriented transversely to the length of the body portion, while the inboard levels are oriented parallel to the length of the body portion. Thus the worker can readily establish a vertical or horizontal line on either side of the handle.

The sockets 24 extend through the body portion and are formed with a central shoulder 28 on which the bubble components are secured by screws 30. The bubble components include upper and lower annular retainers 32 and 34, upper and lower transparent cups 36 and 38 and a cylindrical bubble vial 40 seated in cooperating notches formed in the sides of the retainer cups. By removing the screws holding the parts in place, the entire bubble unit or any component thereof may be replaced in the event of breakage. It will be noted that the walls defining the socket extend to a plane that is flush with the edges of the straight edge so that when the body portion is flat against the surface the walls of the socket contribute to the support and stabilization of the unit.

The T-bar 14 is detachably connected to either end of the body portion by means of a knurled screw 42 threaded through both the end of the body portion and cooperating tapped holes 44 spaced along the T-bar 14. The T-bar 14, in the preferred embodiment, is L-shaped in cross section and includes a relatively wide, flat portion 46 and a relatively shallow lip 48 extending along one edge thereof. The T-bar preferably is of the same material as the body portion and also is formed with spaced openings 50 to reduce weight and improve stability of the T-bar portion. The T-bar may also be provided with replaceable bubble level units 52, similar to those in the body portion, so that the T-bar, whether used with or without the body portion, may serve both as a straight edge as well as a level. The bubble levels may be oriented perpendicularly to one another to provide both horizontal and vertical reference lines.

In order to provide a rigid connecting fit between the T-bar and the body portion, the ends of the body portion are cut away transversely at 54 and 56 to mate with the cross-sectional configuration of the T-bar when connected thereto. In the illustrated embodiment, with the T-bar mounted with the lip 48 extending upwardly, the bottom face of the tool will be flush throughout so that the tool may be laid in full contact against a flat surface such as a wall, or the like. However, the T-bar may be inverted, as suggested in FIG. 4, so that the lip 48 will be extending downwardly where the tool is being used over an edge of the work piece. For example, in this position the tool may be used to mark panels with a cutting line or engage the edge of a sheet of plasterboard so that a scoring line may be cut with an appropriate cutting tool being run along one of the straight edges of the body portion.

The T-bar may be conducted to the body portion in the manner illustrated in FIGS. 1 and 3 in a conventional T-square configuration, or it may be set to either side, as suggested in FIG. 5, so that the tool may be used in corner work, or the like, with the end of the T-bar flush with the outside edge of the body portion.

The T-bar 14 may be provided with an optional detachable handle 58 so that the T-bar may be used separately for straight edge work apart from the body portion and, preferably, the handle 58 is offset, as best shown in FIGS. 7 and 8. In this fashion, depending upon the orientation of the handle, one of the edges will be clear for running a cutting tool, for example, along one edge or for tearing paper along one of the edges, as is commonly done in paper-hanging work. If desied, the T-bar may be formed with a bevelled edge 60 to aid in tearing paper and also the T-bar may be marked for linear measurement purposes to function as a ruler.

The tool is highly functional and when used in paper-hanging work, the T-bar may be removed and the main body portion used alone, first to inscribe or obtain true vertical lines, and also to establish horizontal lines. Quite often in buildings, homes in particular, the ceilings are not always a truly horizontal and may tend to be higher in one section than in another section, with the result that compensation must be made when hanging wallcoverings, particularly where the covering has a distinct repeat pattern. Since the tool is long, wide and flat and has integral bubble levels, the worker may place the tool against the wall and obtain a true vertical line which he may then mark against the wall by running a pencil or the like down one edge while holding the tool with the handle. Such is not possible using a conventional level because conventional levels are relatively short and are not provided with straight edges or with handles. The wide body of the tool, together with its great length, allows the tool to be used to make a single, long reference line in one motion. The tool also is useful for making razor cuts through various materials such as paper, carpets, vinyls, foils, etc., in a long, straight path. Very often in wallcovering work adjacent strips of wallcovering are double cut by overlapping and then making a cut freehand along the overlapping portions, with the cut portions being removed and the remaining portions being pressed flat against the wall with their edges abutting. The freehand cut is often irregular, and using the present instrument, a truly straight, vertical cut may be made neatly and cleanly in a way that the cut is almost imperceptible.

Having thus described the invention, what I claim and desire to obtain by Letters Patent of the United States is:

1. A multi-purpose tool, comprising
   a. a relatively thick, stiff and straight elongated body formed with parallel bevelled faces adjacent each long edge thereof and one one side thereof,
   b. said body being marked with measuring indicia along at least one long edge thereof and on the bevelled face thereof,
   c. a handle mounted medially to said one face of said body,
   d. said body being formed with a plurality of longitudinally spaced sockets in said one face,
   e. a bubble level mounted in each of said sockets,
   f. first fastening means detachably securing each of said bubble levels in said socket,
   g. at least one end of said body being formed with a pair of transverse grooves defining a stepped transverse notch across the other face of said body,
   h. a T-bar of L-shaped cross-section to conform in size and profile with said notch, and,
   i. second fastening means detachably connecting said T-bar in said notch perpendicular to the length of said body,
   j. said T-bar being formed with a flat, straight portion having a thickness and width corresponding to the depth and width of one portion of said groove and a lip along one edge thereof corresponding in thickness and width to the depth and width of the other of said grooves, whereby the outer face of said T-bar will be flush with the other face of said body when connected thereto and the end of said body will be flush with the outer edge of said T-bar.

2. A multi-purpose tool, according to claim 1, wherein said T-bar is formed with a plurality of tapped holes spaced along the length thereof, said body being formed with a tapped hole at least at said one end thereof through said one face and a screw threaded through said body hold and one of said bar holes.

3. A multi-purpose tool, according to claim 2, including an offset handle and screw means detachably mounting said offset handle medially to said T-bar.

4. A multi-purpose tool, according to claim 2, wherein said T-bar is formed with a plurality of longitudinally spaced sockets in one face thereof, a bubble level mounted in each of said sockets and third fastening means detachably securing each of said bubble levels in said T-bar sockets.

5. A multi-purpose tool, according to claim 1, wherein said body is arched in transverse cross-section and formed with a plurality of openings along the length thereof.

* * * * *